US007450864B2

(12) United States Patent
Lee

(10) Patent No.: US 7,450,864 B2
(45) Date of Patent: Nov. 11, 2008

(54) METHOD AND APPARATUS FOR OBTAINING REFILLED TONER DATA

(75) Inventor: Sangmin Lee, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 263 days.

(21) Appl. No.: 11/224,065

(22) Filed: Sep. 13, 2005

(65) Prior Publication Data

US 2006/0093381 A1 May 4, 2006

(30) Foreign Application Priority Data

Nov. 4, 2004 (KR) ..... 10-2004-0089216

(51) Int. Cl.
*G03G 15/08* (2006.01)

(52) U.S. Cl. ..... 399/8; 399/27

(58) Field of Classification Search ..... 399/8, 399/12, 15, 27, 28, 29

See application file for complete search history.

(56) References Cited

U.S. PATENT DOCUMENTS

| | | | | |
|---|---|---|---|---|
| 5,930,553 | A * | 7/1999 | Hirst et al. | 399/8 |
| 6,226,025 | B1 | 5/2001 | Kim | 347/228 |
| 6,301,449 | B1 * | 10/2001 | Miura | 399/12 |
| 6,363,226 | B1 * | 3/2002 | Batori | 399/8 |
| 6,625,402 | B2 * | 9/2003 | Takemoto | 399/8 |
| 6,865,349 | B2 * | 3/2005 | Silence et al. | 399/8 |
| 2004/0101320 | A1 * | 5/2004 | Haramoto | 399/12 |

FOREIGN PATENT DOCUMENTS

| | | |
|---|---|---|
| EP | 598186 A1 * | 5/1994 |
| JP | 2002-278379 | 9/2002 |
| JP | 2002-287920 | 10/2002 |
| JP | 2003-084631 | 3/2003 |
| JP | 2003-162187 | 6/2003 |

OTHER PUBLICATIONS

Chinese Office Action mailed Dec. 21, 2007 in corresponding Chinese Application No. 2005101088167.

* cited by examiner

*Primary Examiner*—Robert Beatty
(74) *Attorney, Agent, or Firm*—Staas & Halsey LLP

(57) ABSTRACT

An apparatus and method for obtaining data regarding toner refilled in an image forming apparatus, to achieve the highest printing quality using the refilled toner. The method includes checking whether the image forming apparatus has been refilled with toner; checking whether toner identification information is present, when the image forming apparatus has been refilled with toner; obtaining toner data using the toner identification information from outside the image forming apparatus, when the toner identification information is present; and determining the toner data in the image forming apparatus, when no toner identification information is present. Accordingly, when the image forming apparatus is refilled with better toner than the original, it is possible to improve the quality of printing by setting data regarding the refilled toner in the image forming apparatus.

19 Claims, 3 Drawing Sheets

METHOD AND APPARATUS FOR OBTAINING REFILLED TONER DATA

CROSS-REFERENCE TO RELATED APPLICATION

This application claims the priority of Korean Patent Application No. 2004-0089216, filed on Nov. 4, 2004, in the Korean Intellectual Property Office, the disclosure of which is incorporated herein by reference.

BACKGROUND OF THE INVENTION

1. Field of the Invention

The present invention relates to a method of and apparatus for obtaining data regarding refilled toner, and more particularly, to a method and apparatus for obtaining data regarding toner refilled in an image forming apparatus, to acquire the highest printing quality using the refilled toner.

2. Description of Related Art

An image forming apparatus, e.g., a printer or a multifunctional apparatus, receives a character or image data signal and reproduces characters or images on a recording medium. The multifunctional apparatus has plural functions such as those of a printer, a scanner, a duplicator, and a facsimile machine. In general, the image forming apparatus includes a photoreceptor (e.g., a photoreceptor drum or a photoreceptor belt) that forms a latent electrostatic image, a charging unit that charges the photoreceptor, an exposing unit that exposes the photoreceptor to light to selectively remove the charge and forms a latent electrostatic image, a developing device that develops the latent electrostatic image by supplying a developing medium, e.g., toner, onto the exposed latent electrostatic image, and a transcribing device that transcribes the developed image onto a recording medium.

In general, when the image forming apparatus completely consumes its toner, the developing device is replaced or toner is refilled into the old developing device. If the quality of the refilled toner is better than that of the consumed toner, or the quality of the toner in the new developing device is better than that of toner in the old developing device, toner information is changed. A characterization value of a printer driver or the firmware or engine of the image forming apparatus may be set according to the toner information. In this case, when the quality of toner is improved, the characterization value must be changed according to the information regarding the improved toner quality. However, conventionally, even if the quality of toner is improved, the characterization value is not changed, thereby limiting the possible improvement in printing quality.

U.S. Pat. No. 6,226,025 discloses a method of obtaining the highest printing quality even when a developer is changed. Although this patent teaches effective management of a developer and a developing unit, it does not suggest a method of acquiring information regarding toner.

BRIEF SUMMARY

An aspect of the present invention provides a method of obtaining data regarding toner refilled in an image forming apparatus, to achieve the highest printing quality using the refilled toner.

An aspect of the present invention also provides an apparatus for obtaining data regarding toner refilled in an image forming apparatus, to achieve the highest printing quality using the refilled toner.

According to an aspect of the present invention, there is provided a method of obtaining data regarding toner refilled in an image forming apparatus to obtain the highest printing quality using the refilled toner, the method comprising checking whether the image forming apparatus has been refilled with toner; checking whether toner identification information is present, when the image forming apparatus has been refilled with toner; obtaining toner data using the toner identification information from outside the image forming apparatus, when the toner identification information is present; and determining the toner data in the image forming apparatus, when no toner identification information is present.

According to another aspect of the present invention, there is provided an apparatus for obtaining data regarding toner refilled in an image forming apparatus, to obtain the highest printing quality using the refilled toner, the apparatus comprising a first checking unit which checks whether the image forming apparatus has been refilled with toner; a second checking unit which checks whether identification information regarding the refilled toner is present, when the image forming apparatus has been refilled with toner; an obtaining unit which obtains the data regarding the refilled toner using the identification information regarding the refilled toner, from outside the image forming apparatus, when identification information regarding the refilled toner is present; and a determining unit which determines toner data in the image forming apparatus when no identification information regarding the refilled toner is present.

According to another aspect of the present invention, there is provided an apparatus for maximizing a printing quality of an image forming apparatus using refilled toner, including: a refilled toner checking unit which checks whether the image forming apparatus has been refilled with toner; a toner identification information checking unit which checks whether identification information regarding the refilled toner is present, when the image forming apparatus has been refilled with toner; a toner data obtaining unit which obtains the data regarding the refilled toner using the identification information regarding the refilled toner, from outside the image forming apparatus, when identification information regarding the refilled toner is present; and a toner data determining unit which determines toner data in the image forming apparatus when no identification information regarding the refilled toner is present.

According to another aspect of the present invention, there is provided an image forming apparatus, including: a controller which controls the overall function of the image forming apparatus and includes an apparatus for obtaining data regarding toner refilled in the image forming apparatus; a toner data unit which stores information regarding toner filled in the image forming apparatus; and a table unit which stores data regarding toner characteristics. When a print job begins, the controller reads information regarding the toner from the toner data unit and sets tables in the table unit according to the read information so that, when the image forming apparatus is refilled with toner, tables regarding the refilled toner are set and stored in the table unit based on the information stored in the toner data unit. The the apparatus for obtaining data regarding toner refilled in the image forming apparatus includes a refilled toner checking unit which checks whether the image forming apparatus has been refilled with toner, a toner identification information checking unit which checks whether identification information regarding the refilled toner is present, when the image forming apparatus has been refilled with toner, a toner data obtaining unit which obtains the data regarding the refilled toner using the identification information regarding the refilled toner, from outside the image forming apparatus, when identification information regarding the refilled toner is present, and a toner data determining unit which determines toner data in the image forming apparatus when no identification information regarding the refilled toner is present.

Additional and/or other aspects and advantages of the present invention will be set forth in part in the description which follows and, in part, will be obvious from the description, or may be learned by practice of the invention.

BRIEF DESCRIPTION OF THE DRAWINGS

The above and/or other aspects and advantages of the present invention will become apparent and more readily appreciated from the following detailed description, taken in conjunction with the accompanying drawings of which.

DETAILED DESCRIPTION OF EMBODIMENTS

Figure 1:
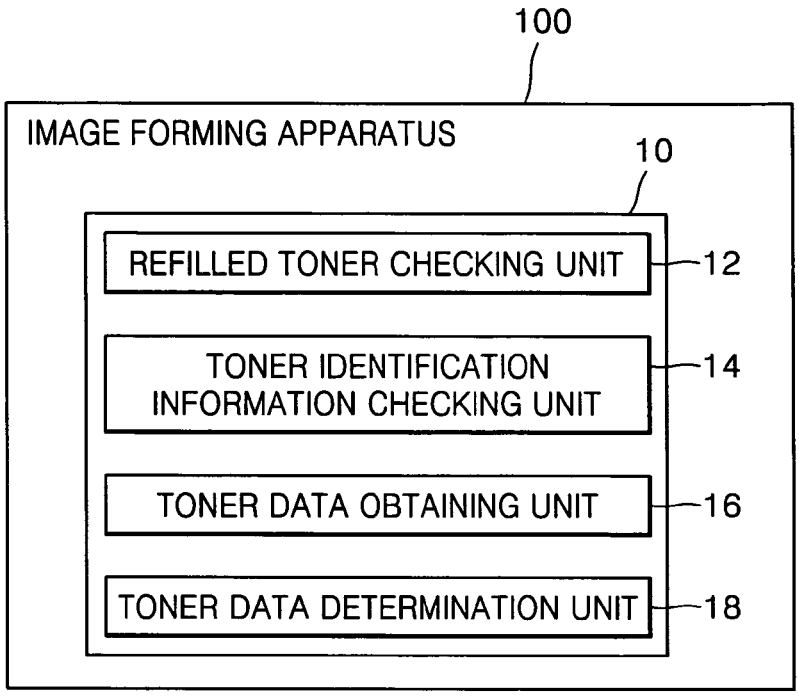
FIG. 1 is a block diagram of an apparatus for obtaining data regarding refilled toner according to an embodiment of the present invention.

Reference will now be made in detail to embodiments of the present invention, examples of which are illustrated in the accompanying drawings, wherein like reference numerals refer to the like elements throughout. The embodiments are described below in order to explain the present invention by referring to the figures.

FIG. 1 is a block diagram of an apparatus 10 for obtaining information regarding toner refilled in an image forming apparatus 100 to achieve the highest printing quality using the refilled toner, according to an embodiment of the present invention. The apparatus 10 includes a refilled toner checking unit 12, a toner identification (ID) information checking unit 14, a toner data obtaining unit 16, and a toner data determination unit 18.

The refilled toner checking unit 12 determines whether the image forming apparatus 100 has been refilled with toner. When it is determined that the image forming apparatus 100 has been refilled with toner, the toner ID information checking unit 14 determines whether toner ID information is present. If toner ID information is present, the toner data obtaining unit 16 obtains toner data from outside the image forming apparatus 100, using the toner ID information. If no toner ID information is present, the toner data determination unit 18 determines the toner data in the image forming apparatus 100.

Figure 2:
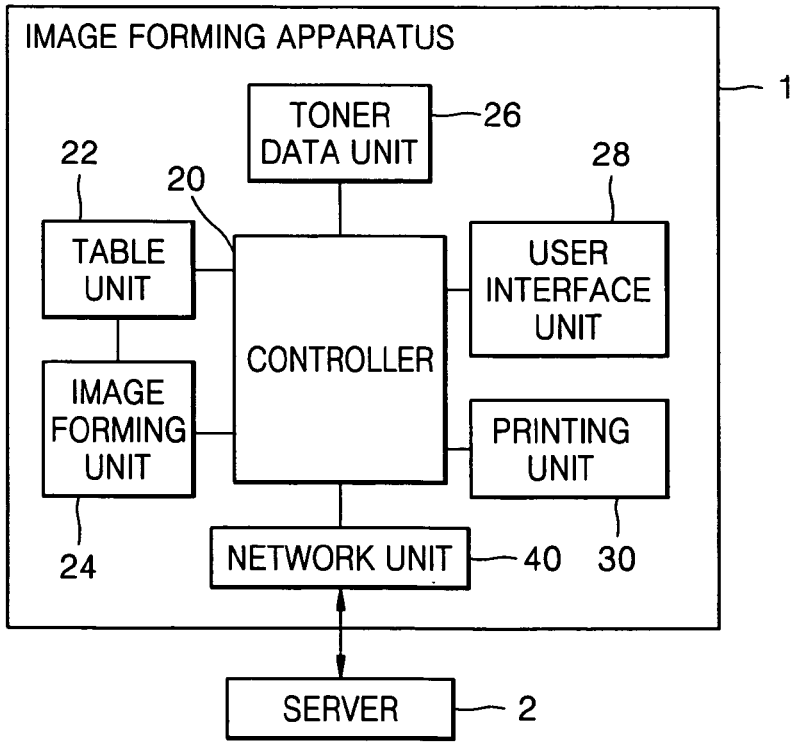
FIG. 2 is a block diagram of an image forming apparatus according to an embodiment of the present invention.

The toner data obtaining unit 16 obtains the toner data from a server, such as a server 2 of FIG. 2, which is connected to the image forming apparatus 100 and stores the toner data. The toner data obtaining unit 16 transmits the toner ID information and ID information regarding the image forming apparatus 100 to the server via a network, and receives toner data corresponding to the toner ID information from the server.

The toner data determination unit 18 prints a plurality of sample pages using data regarding various types of toner, stored in the image forming apparatus 100. The toner data determination unit 18 allows a user to select the sample page showing the highest printing quality, and sets the data used to print the selected page as basic toner data.

The toner data may include least one of a color table, a grayscale table, and a transfer voltage table. The toner data may be used as a characterization value of a printer driver or the firmware or engine of an image forming apparatus.

In an alternative embodiment, the apparatus 10 may be included in a controller of an image forming apparatus.

FIG. 2 is a block diagram of the image forming apparatus 1 according to an embodiment of the present invention, in which the apparatus 10 is includable in a controller. The image forming apparatus 1 includes a controller 20, a table unit 22, an image forming unit 24, a toner data unit 26, a user interface unit 28, a printing unit 30, and a network unit 40.

The controller 20 controls the overall function of the image forming apparatus 1. The table unit 22 stores data regarding toner characteristics. The data stored in the table unit 22 may be updated or changed under the control of the controller 20. The data regarding toner characteristics includes a color table, a grayscale table, and a transfer voltage table. The table unit 22 may further include tables referring to when a print job is performed, and tables for changing the quality of the refilled toner. The image forming unit 24 may create print job data based on the tables stored in the table unit 22.

When a print job begins, the controller 20 may read information regarding the toner from the toner data unit 26 and set tables in the table unit 22 according to the read information. This operation is preferably performed only once, when the image forming apparatus 1 is refilled with toner. In other words, when the image forming apparatus 1 is refilled with toner, tables regarding the refilled toner may be set and stored in the table unit 22, based on the information stored in the toner data unit 26.

The user interface unit 28 displays a dialogue box through which user input is entered. The network unit 40 is connected to a server 2 outside the image forming apparatus 1, to transmit data to and receive data from the server 2. The toner data unit 26 stores information regarding toner filled in the image forming apparatus 1, and uses a memory (not shown) installed in a toner cartridge (not shown). The printing unit 30 receives print job data from the image forming unit 24 and performs the print job.

Figure 3:
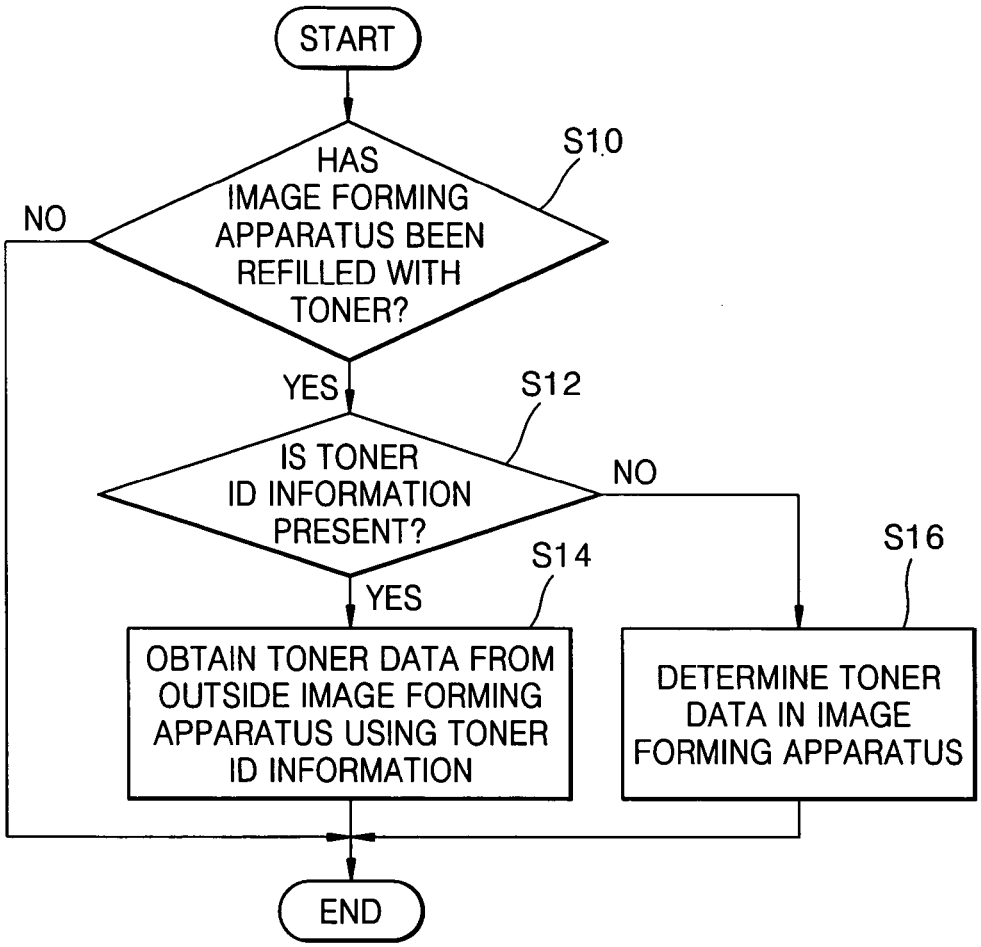
FIG. 3 is a flowchart illustrating a method of obtaining information regarding refilled toner according to an embodiment of the present invention.

FIG. 3 is a flowchart illustrating a method of obtaining data regarding toner refilled in an image forming apparatus to achieve the highest printing quality using the refilled toner, according to an embodiment of the present invention. Referring to FIG. 3, it is determined whether the image forming apparatus has been refilled with toner (operation S10). If the image forming apparatus has not been refilled with toner, the method ends.

When it is determined in operation S10 that the image forming apparatus has been refilled with toner, it is determined whether toner ID information is present (operation S12). If toner ID information is present, toner data is obtained from outside the image forming apparatus, using the toner ID information (operation S14). If it is determined in operation S12 that no toner ID information is present, the toner data is determined in the image forming apparatus (operation S16).

In operation S14, the toner data may be received from a server that is connected to the image forming apparatus and stores data regarding the toner data. Also, operation S14 may further include transmitting the toner ID information and ID information regarding the image forming apparatus to the server via a network, and receiving toner data, which corresponds to the toner ID information and ID information regarding the image forming apparatus, from the server.

In operation S16, a plurality of sample pages are printed using information stored in the image forming apparatus regarding various types of toner. Also, operation S16 may further include allowing the user to select the sample page showing the highest printing quality, and setting the toner data used to print the selected page as basic toner data.

The toner data may include at least one of a color table, a grayscale table, and a transfer voltage table.

Figure 4:
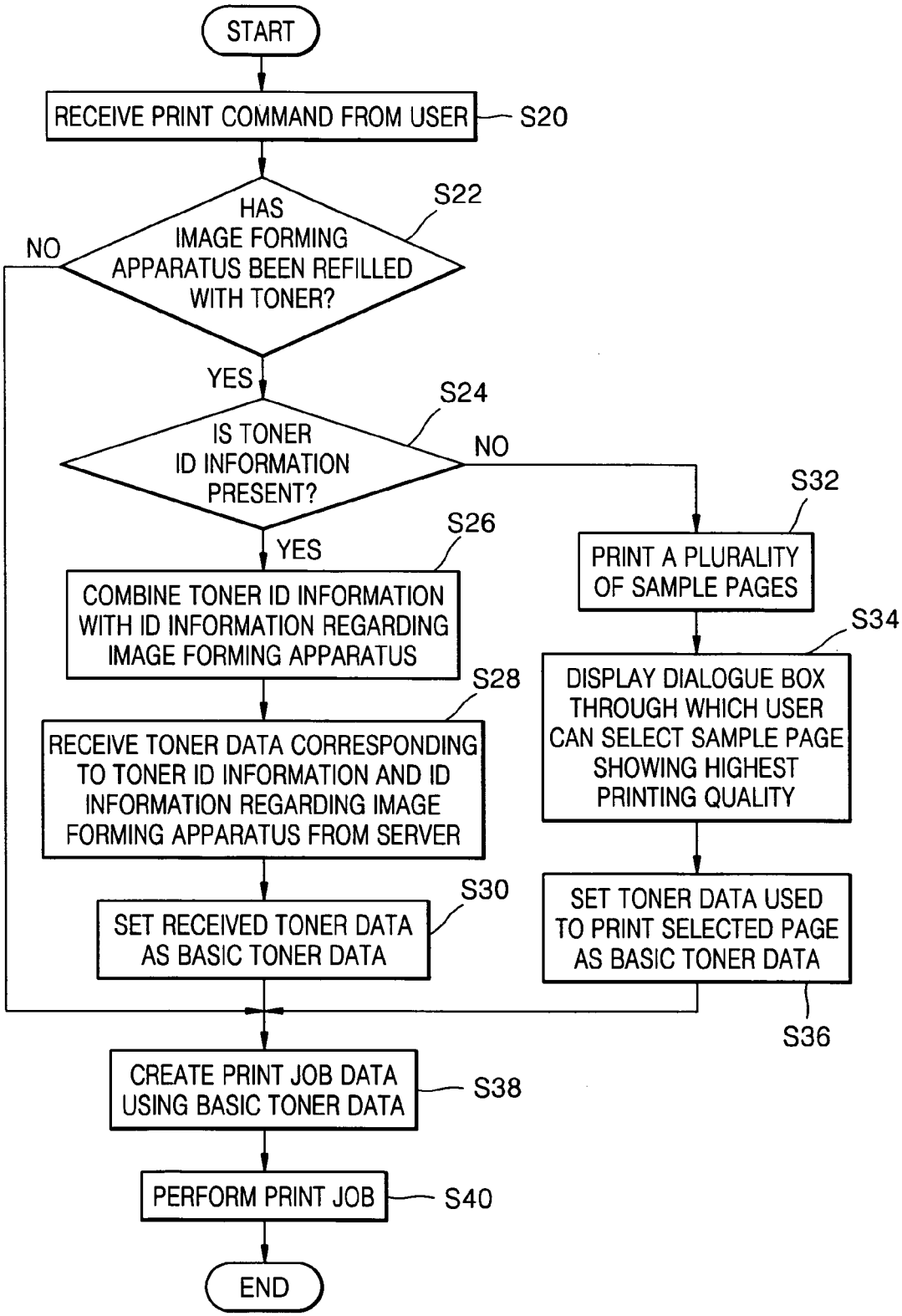
FIG. 4 is a detailed flowchart of the method of FIG. 3.

A method of obtaining data regarding refilled toner according to an embodiment of the present invention will now be described with reference to FIGS. 2 and 4.

In the method, a print command is received from a user (operation S20). Next, the controller 20 reads toner data from the toner data unit 26 to determine whether the image forming apparatus 1 has been refilled with toner (operation S22).

To determine whether the image forming apparatus 1 has been refilled with toner, a line may be inserted into the cover of a toner cartridge such that the line is broken when the cover is separated from the toner cartridge. Otherwise, when the cover is separated from the toner cartridge, information stored in a memory installed in the toner cartridge may be deleted. When the line is cut or the information is deleted from the memory, it is determined that the image forming apparatus has been refilled with toner.

When it is determined in operation S22 that the image forming apparatus has been refilled with toner, the controller 20 determines whether toner ID information is stored in the toner data unit 26 (operation S24). If toner ID information is present in the toner data unit 26, the controller 20 reads the toner ID information from the toner data unit 26, combines it with ID information regarding the image forming apparatus 1, and transmits the result to the network unit 40 (operation S26). The network unit 40 transmits the result to the server 2. Next, the network unit 40 receives, from the server 2, toner data corresponding to the toner ID information and the ID information regarding the image forming apparatus, and sends the received toner data to the controller 20 (operation S28). The controller 20 receives the toner data from the network unit 40 and stores it in the toner data unit 26 and the table unit 22, and sets the received toner data as basic toner data (operation S30). Next, the image forming unit 24 creates print job data using the basic toner data (operation S38), and the printing unit 30 performs a print job (operation S40).

If it is determined in operation S24 that no toner ID information is stored in the toner data unit 26, the controller 20 controls the printing of a plurality of sample pages using data regarding various types of toner, stored in the table unit 22 (operation S32). Next, the user interface unit 28 displays a dialogue box through which the user can select the sample page showing the highest printing quality (operation S34). Next, the toner data used to print the selected page is set as basic toner data (operation S36). Specifically, the toner data used to print the selected page is set as basic toner data or a default table in the table unit 22, and the toner data is transmitted to and stored in the toner data unit 26. Next, the image forming unit 24 creates print job data using the basic toner data (operation S38), and a print job is performed (operation S40).

If it is determined in operation S22 that the image forming apparatus has not been refilled with toner, the controller 20 controls the image forming unit 24 to create print job data using the basic toner data, e.g., tables including toner data, which is set as default data in the table unit 22 (operation S38), and controls the printing unit 30 to perform a print job (operation S40).

According to the above-described embodiments of the present invention, when an image forming apparatus is refilled with better than original toner, data regarding the refilled toner is set in the image forming apparatus, thereby improving the quality of printing. Accordingly, even when an old model printer is refilled with high-quality toner, or an image forming apparatus is refilled with low-quality toner, it is possible to guarantee the highest printing quality.

Although a few embodiments of the present invention have been shown and described, the present invention is not limited to the described embodiments. Instead, it would be appreciated by those skilled in the art that changes may be made to these embodiments without departing from the principles and spirit of the invention, the scope of which is defined by the claims and their equivalents.

What is claimed is:

1. A method of obtaining data regarding toner refilled in an image forming apparatus, the method comprising:

checking whether the image forming apparatus has been refilled with toner by a predetermined confirming part;

checking whether toner identification information is present, when the image forming apparatus has been refilled with toner; and obtaining toner data using the toner identification information from outside the image forming apparatus, when the toner identification information is present.

2. The method of claim 1, wherein the obtaining comprises obtaining the toner data from a server which is connected to the image forming apparatus and which stores the toner data.

3. The method of claim 2, further comprising:

transmitting the toner identification information and identification information regarding the image forming apparatus to the server via a network; and receiving toner data, which corresponds to the toner identification information and the identification information regarding the image forming apparatus, from the server.

4. The method of claim 1, further comprising determining the toner data in the image forming apparatus, when no toner identification information is present.

5. The method of claim 4, wherein the determining comprises printing a plurality of sample pages using toner data regarding various types of toner, which toner data has been stored in the image forming apparatus.

6. The method of claim 5, wherein the determining further comprises:

allowing a user to select the sample page showing the highest printing quality; and setting the toner data used to print the selected page as basic toner data.

7. The method of claim 1, wherein the toner data comprises a color table, a grayscale table, or a transfer voltage table.

8. An apparatus for obtaining data regarding toner refilled in an image forming apparatus, to obtain the highest printing quality using the refilled toner, the apparatus comprising:

a first checking unit which checks whether the image forming apparatus has been refilled with toner;

a second checking unit which checks whether identification information regarding the refilled toner is present, when the image forming apparatus has been refilled with toner;

an obtaining unit which obtains the data regarding the refilled toner using the identification information regarding the refilled toner, from outside the image forming apparatus, when identification information regarding the refilled toner is present; and a determining unit which determines toner data in the image forming apparatus when no identification information regarding the refilled toner is present.

9. The apparatus of claim 8, wherein the obtaining unit obtains the toner data from a server which is connected to the image forming apparatus and which stores the toner data.

10. The apparatus of claim 9, wherein the obtaining unit transmits the identification information regarding the toner and identification information regarding the image forming apparatus to the server via a network, and receives toner data corresponding to the identification information regarding the toner and the identification information regarding the image forming apparatus, from the server.

11. The apparatus of claim 8, wherein the determining unit prints a plurality of sample pages using toner data regarding various types of toner, which toner data has been stored in the image forming apparatus.

12. The apparatus of claim 11, wherein the determining unit allows a user to select the sample page showing the highest printing quality, and sets toner data regarding toner used to print the selected page as basic toner data.

13. The apparatus of claim 8, wherein the data regarding the refilled toner comprises a color table, a grayscale table, or a transfer voltage table.

14. An apparatus for maximizing a printing quality of an image forming apparatus using refilled toner, comprising:

a refilled toner checking unit which checks whether the image forming apparatus has been refilled with toner;

toner identification information checking unit which checks whether identification information regarding the refilled toner is present, when the image forming apparatus has been refilled with toner;

a toner data obtaining unit which obtains the data regarding the refilled toner using the identification information regarding the refilled toner, from outside the image forming apparatus, when identification information regarding the refilled toner is present; and a toner data determining unit which determines toner data in the image forming apparatus when no identification information regarding the refilled toner is present.

15. An image forming apparatus, comprising;

a controller which controls the overall function of the image forming apparatus and includes an apparatus for obtaining data regarding toner refilled in the image forming apparatus;

a toner data unit which stores information regarding toner filled in the image forming apparatus; and a table unit which stores data regarding toner characteristics, wherein, when a print job begins, the controller reads information regarding the toner from the toner data unit and sets tables in the table unit according to the read information so that, when the image forming apparatus is refilled with toner, tables regarding the refilled toner are set and stored in the table unit based on the information stored in the toner data unit, and wherein the apparatus for obtaining data regarding toner refilled in the image forming apparatus comprises a refilled toner checking unit which checks whether the image forming apparatus has been refilled with toner, a toner identification information checking unit which checks whether identification information regarding the refilled toner is present, when the image forming apparatus has been refilled with toner, a toner data obtaining unit which obtains the data regarding the refilled toner using the identification information regarding the refilled toner, from outside the image forming apparatus, when identification information regarding the refilled toner is present, and a toner data determining unit which determines toner data in the image forming apparatus when no identification information regarding the refilled toner is present.

16. The apparatus of claim 15, wherein the data stored in the table unit is updated or changed by the controller.

17. The apparatus of claim 15, wherein the table unit stores tables referring to when a print job is performed, and tables for changing the quality of the refilled toner.

18. The apparatus of claim 14, wherein the toner data is used as a characterization value of a printer driver, the firmware of the image forming apparatus, or an engine of the image forming apparatus.

19. The method of claim 1, wherein the predetermined confirming part comprises a line inserted into the cover of a toner cartridge such that the line is broken when the cover is separated from the toner cartridge.

* * * * *

UNITED STATES PATENT AND TRADEMARK OFFICE

CERTIFICATE OF CORRECTION

PATENT NO. : 7,450,864 B2
APPLICATION NO. : 11/224065
DATED : November 11, 2008
INVENTOR(S) : Sang-min Lee It is certified that error appears in the above-identified patent and that said Letters Patent is hereby corrected as shown below:

Column 7, Line 23, before “toner” insert --a--.

Column 7, Line 35, change “comprising;” to --comprising:--.

Signed and Sealed this

Tenth Day of February, 2009

John Doll

JOHN DOLL
*Acting Director of the United States Patent and Trademark Office*